US011661882B1

(12) United States Patent
St. Pierre

(10) Patent No.: US 11,661,882 B1
(45) Date of Patent: May 30, 2023

(54) MODIFIED EXHAUST SYSTEM WITH OXYGEN SENSOR

(71) Applicant: Normand A. St. Pierre, Williston, FL (US)

(72) Inventor: Normand A. St. Pierre, Williston, FL (US)

( * ) Notice: Subject to any disclaimer, the term of this patent is extended or adjusted under 35 U.S.C. 154(b) by 50 days.

(21) Appl. No.: 17/355,732

(22) Filed: Jun. 23, 2021

Related U.S. Application Data

(60) Provisional application No. 63/042,728, filed on Jun. 23, 2020.

(51) Int. Cl.

| | |
|---|---|
| ***F01N 13/00*** | (2010.01) |
| ***F01N 13/18*** | (2010.01) |
| ***F02B 75/18*** | (2006.01) |
| ***F01N 11/00*** | (2006.01) |
| ***F01N 13/10*** | (2010.01) |

(52) U.S. Cl.
CPC ..... *F01N 13/008* (2013.01); *F01N 11/007* (2013.01); *F01N 13/10* (2013.01); *F01N 13/1805* (2013.01); *F02B 75/18* (2013.01); *F02B 2075/1812* (2013.01)

(58) Field of Classification Search
CPC ..... F01N 13/10; F01N 13/08; F01N 13/1805; F01N 13/1877; F01N 2290/10; F01N 13/008; F01N 1/06; F01N 2240/20; F01N 1/166; F01N 1/026; F01N 2470/16; F01N 2470/14; F02D 35/0015
See application file for complete search history.

(56) References Cited

U.S. PATENT DOCUMENTS

| | | | | |
|---|---|---|---|---|
| 3,444,687 | A * | 5/1969 | Louis | F01N 3/10 181/259 |
| 4,953,352 | A * | 9/1990 | Campbell | F01N 13/08 60/323 |
| 5,214,253 | A * | 5/1993 | Houston, Jr. | F01N 13/08 181/239 |
| 5,867,985 | A * | 2/1999 | Furuhashi | F01N 13/10 60/323 |
| 6,478,340 | B1 * | 11/2002 | Butler | F16L 41/023 60/323 |
| 6,647,714 | B1 * | 11/2003 | Gerber | F02B 27/04 60/323 |
| 7,021,052 | B1 * | 4/2006 | Hicks | F02B 27/04 60/314 |
| 7,610,748 | B2 * | 11/2009 | Kono | F01N 13/008 60/276 |
| 8,209,972 | B2 * | 7/2012 | Tuch | F01N 13/1888 60/272 |
| 8,468,802 | B2 * | 6/2013 | Mueller | B01F 25/431 60/303 |

(Continued)

*Primary Examiner* — Anthony Ayala Delgado

(57) ABSTRACT

The invention presented is a crossover section for a vehicle exhaust system that includes a middle pipe and two outer pipes, each outer pipe in contact with and attached to the middle pipe. Diversion gates extend from the middle pipe into each of the outer pipes to divert a sample of exhaust gas into the middle pipe. A sensor, such as an oxygen sensor, is provided to measure one or more components of the combined exhaust. Also provided is an exhaust system that includes the inventive crossover section and a vehicle that includes one or more of the inventive exhaust systems.

23 Claims, 7 Drawing Sheets

(56) References Cited

U.S. PATENT DOCUMENTS

| | | | | |
|---|---|---|---|---|
| 2002/0000222 | A1* | 1/2002 | Matsuura | F01N 13/102<br>123/568.11 |
| 2004/0020195 | A1* | 2/2004 | Ashida | F01N 13/1805<br>60/323 |
| 2007/0045041 | A1* | 3/2007 | Krueger | F01N 13/1894<br>181/251 |
| 2009/0126355 | A1* | 5/2009 | Uchida | F01N 11/00<br>60/323 |
| 2009/0173060 | A1* | 7/2009 | Lortet | F02B 37/02<br>60/324 |
| 2010/0146956 | A1* | 6/2010 | Grudynski, III | F01N 13/08<br>60/324 |
| 2011/0154812 | A1* | 6/2011 | Butler | F01N 13/08<br>60/324 |
| 2012/0323466 | A1* | 12/2012 | Iwazaki | F02D 41/0085<br>701/104 |
| 2014/0237991 | A1* | 8/2014 | Nakamura | F01N 13/008<br>60/272 |
| 2016/0024989 | A1* | 1/2016 | Eichmueller | F01N 13/02<br>60/273 |
| 2016/0123211 | A1* | 5/2016 | Takano | F01N 13/10<br>60/323 |
| 2017/0198617 | A1* | 7/2017 | Drees | F01N 13/08 |

* cited by examiner

MODIFIED EXHAUST SYSTEM WITH OXYGEN SENSOR

CROSS REFERENCE TO RELATED APPLICATIONS

This patent application claims the benefit under 35 U.S.C. § 119(e) of U.S. Provisional Application No. 63/042,728, filed Jun. 23, 2020, which application is incorporated herein by reference in its entirety.

FIELD OF THE INVENTION

The field of the invention generally pertains to exhaust systems for internal combustion engines, more particularly to multipipe systems and still more particularly to oxygen ($O_2$) measurement in multipipe systems.

BACKGROUND OF THE INVENTION

Exhaust systems for internal combustion engines on vehicles have become exceedingly complex as different designs are used to increase mileage, reduce pollution and in general increase engine efficiency. On-board computers ("computer") are used to monitor several parameters in gauging engine performance. The measurement of oxygen ($O_2$) levels in exhaust systems is an important parameter by, among other things, enabling the computer to more finely adjust the air-fuel mixture that enters the engine cylinders.

Exhaust systems often comprise a plurality of pipes that each receive exhaust from different cylinders. Oxygen content differs in each of the pipes. At present, oxygen is measured in each pipe or is not measured at all leading to a suboptimal measurement of oxygen in exhaust gas.

What is needed is an exhaust system that enables $O_2$ measurement of mixed exhaust gas in all exhaust pipes, especially in three or six pipe systems extending from three or six cylinder engines

SUMMARY OF THE INVENTION

The invention broadly comprises a crossover section for the exhaust system of an internal combustion engine comprising: a middle pipe having an input end and an output end; a first outer pipe having an input end and an output end and in contact with and attached to the middle pipe; a second outer pipe having an input end and an output end and in contact with and attached to the middle pipe; a first gate extending angularly from the middle pipe into the first outer pipe within the crossover section; a second gate extending angularly from the middle pipe into the second outer pipe within the crossover section; and, a receiver defined by the middle pipe and downstream from the first gate and the second gate. In a preferred embodiment, an oxygen sensor is sized to fit into the receiver.

The invention also broadly comprises an exhaust system for an internal combustion engine comprising: a first exhaust pipe having an intake end and an exhaust end; a middle exhaust pipe having an intake end and an exhaust end; a third exhaust pipe having an intake end and an exhaust end; a crossover section wherein the first exhaust pipe and the third exhaust pipe are fastened or attached to the middle pipe within the crossover section; a receiver defined by the middle pipe within the crossover section; a first gate extending angularly from the middle pipe into the first pipe within the crossover section; and, a second gate extending angularly from the middle pipe into the third pipe within the crossover section. Each of the first gate and the second gate are positioned upstream from the receiver.

In a preferred embodiment, an oxygen sensor is sized to fit into the receiver and detects $O_2$ levels in the combined exhaust streams in the exhaust system. In a preferred embodiment, the vehicle will include at least one on board computer that measures $O_2$ levels in the combined exhaust streams and adjusts engine operation accordingly.

The invention also broadly comprises a vehicle having an internal combustion engine comprising: an exhaust header attached to the internal combustion engine; a first exhaust system including: a first exhaust pipe having an intake end and an exhaust end, the intake end attached to a first exhaust outlet of the header; a middle exhaust pipe having an intake end and an exhaust end, the intake end attached to a second exhaust outlet of the header; a third exhaust pipe having an intake end and an exhaust end, the intake end attached to a third exhaust outlet of the header; a crossover section wherein the first exhaust pipe and the third exhaust pipe are fastened to and contacted by the middle pipe within the crossover section; a receiver defined by the middle pipe within the crossover section; a first gate extending angularly from the middle pipe into the first pipe within the crossover section; and, a second gate extending angularly from the middle pipe into the third pipe within the crossover section. Each of the first gate and the second gate are positioned upstream from the receiver.

In an alternate embodiment, the vehicle includes a second exhaust header with a similar or exact exhaust system attached to the second exhaust header. In a preferred embodiment, the vehicle will include at least one on board computer that measures $O_2$ levels in the combined exhaust streams and adjusts engine operation accordingly.

One object of the invention is to obtain a combined measurement of oxygen levels in a multi-outlet engine exhaust stream.

A second object of the invention is to continually adjust engine output based on changing oxygen levels to achieve a desired engine performance.

A third object is to improve vehicle mileage.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

The present invention is directed to an improved exhaust system for an internal combustion engine ["engine(s)" ] and is particularly suited for internal combustion engines utilizing headers to remove exhaust gases and fumes from the engine. The embodiment discussed below describes the inventive system adapted for a three- or six-cylinder engine especially suited for a two or three wheel motorcycle, a four wheel all-terrain vehicle and other similar vehicles. However, persons having ordinary skill in the art will recognize that the system may be adapted to other multi-cylinders engines and other types of vehicles or other uses requiring such engines or other types of engines.

Figure 1:
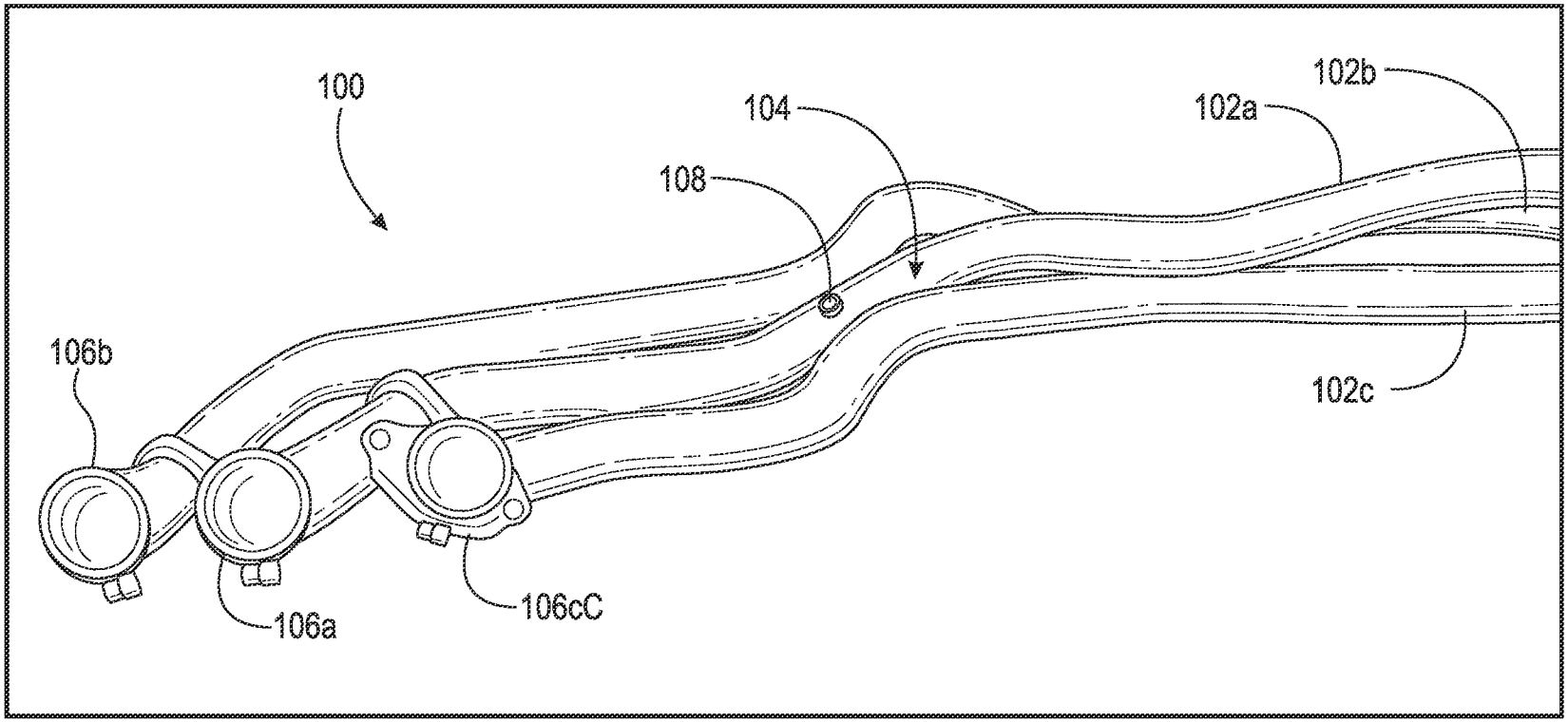
FIG. 1 is a side perspective view of the completed assembly of the exhaust system of the present invention.
Figure 2:
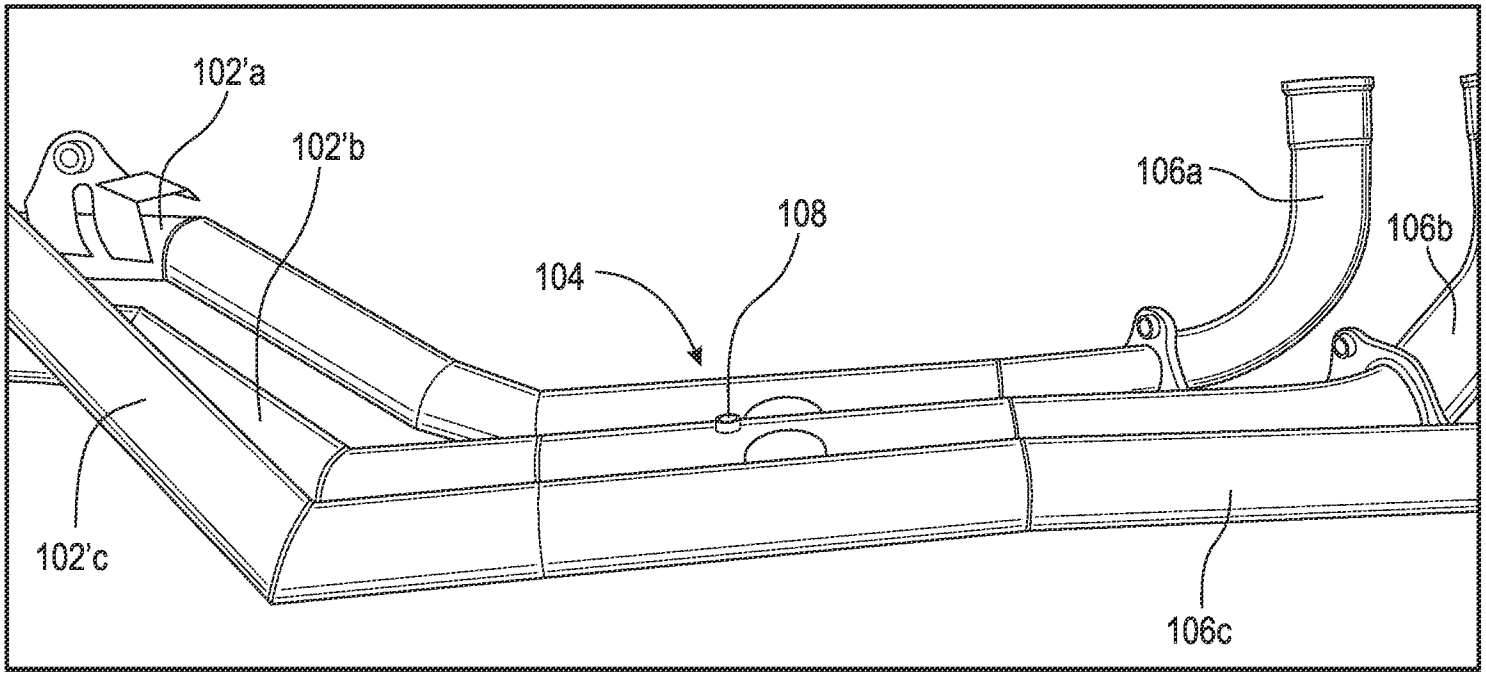
FIG. 2 is a side perspective view of an alternate embodiment of the inventive exhaust system in which the turns in each outlet pipe are made by sharp angles.

Exhaust pipes ("pipes") extending from headers may be joined together by crossover sections or regions in which the pipes are joined together by welding or other suitable methods to form one unitary multi-pipe component of the exhaust system. FIG. 1 is a side perspective view of a preferred embodiment of the completed assembly of the exhaust system 100 of the present invention showing exhaust outlet pipes 102*a*, 102*b*, and 102*c* (collectively "pipes 102") attached to the downstream end of crossover 104 with attached exhaust inlet pipes 106*a*, 106*b*, and 106*c* (collectively "pipes 106") extending forward from crossover 104 each to a separate exhaust outlet from an exhaust manifold (not shown). FIG. 2 is a side perspective view of an alternate embodiment of the inventive exhaust system in which the turns in each outlet pipe 102'*a*, 102'*b*, and 102'*c* are made by sharp angles. In one embodiment, the sharp angles may be fabricated by welding separate pieces of piping to form a single outlet pipe.

Figure 3:
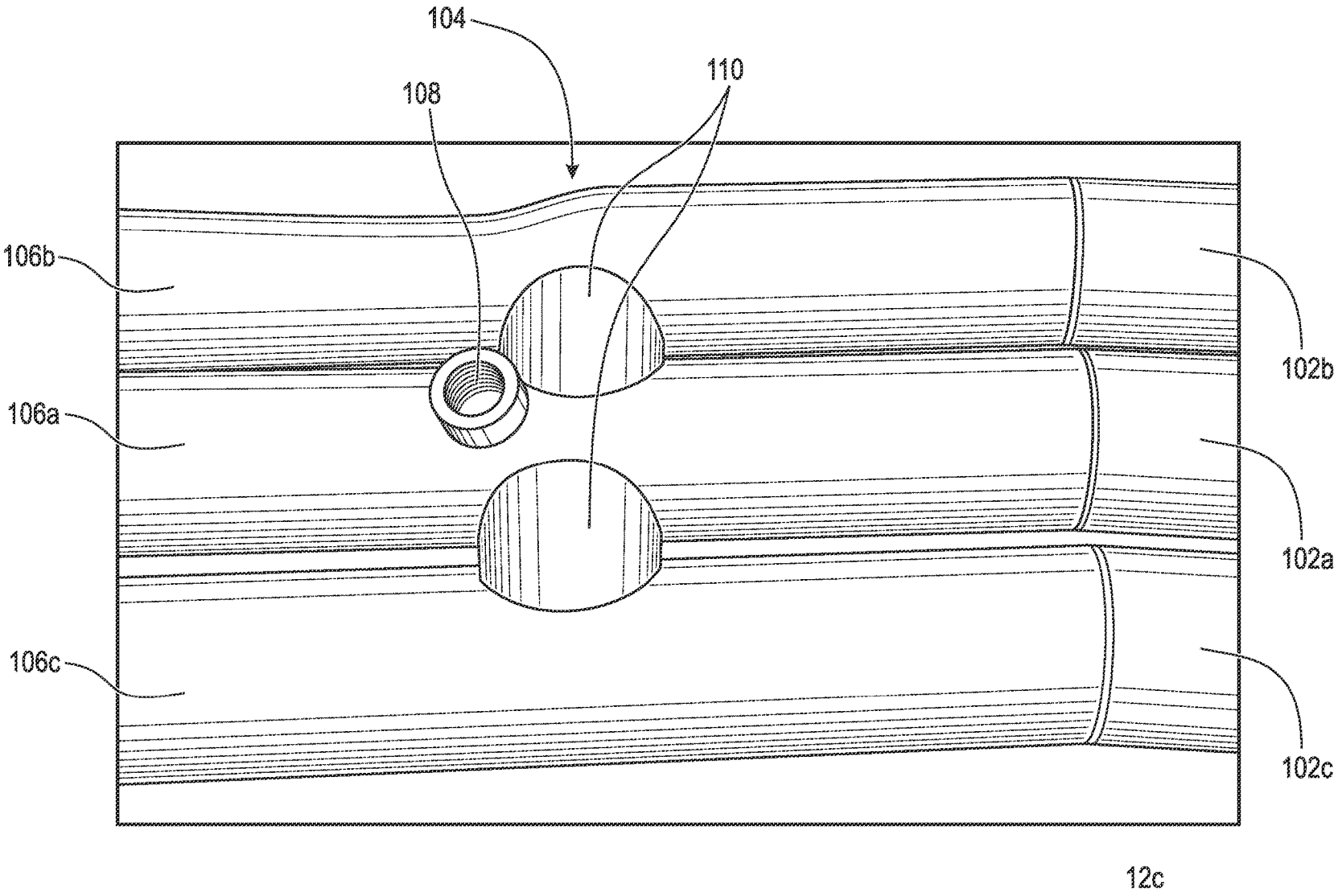
FIG. 3 is a close-up top perspective view of the crossover section of the exhaust system.

FIG. 3 is a close-up top perspective view of crossover section 104 of the exhaust system 100. Receiver 108 is defined by middle inlet pipe 106*a* and is depicted in a preferred embodiment that includes a threaded interior to receive and hold securely a sensor such as an oxygen sensor (not seen in FIG. 3). Attachments 110 hold the three pipes in crossover section 104 together, preferably in contact with each other, to form an integral crossover region 104 of exhaust system 100. Such attachments may be welds, straps, nut and bolt assemblies or other attachment means known to those skilled in the art.

Figure 4A:
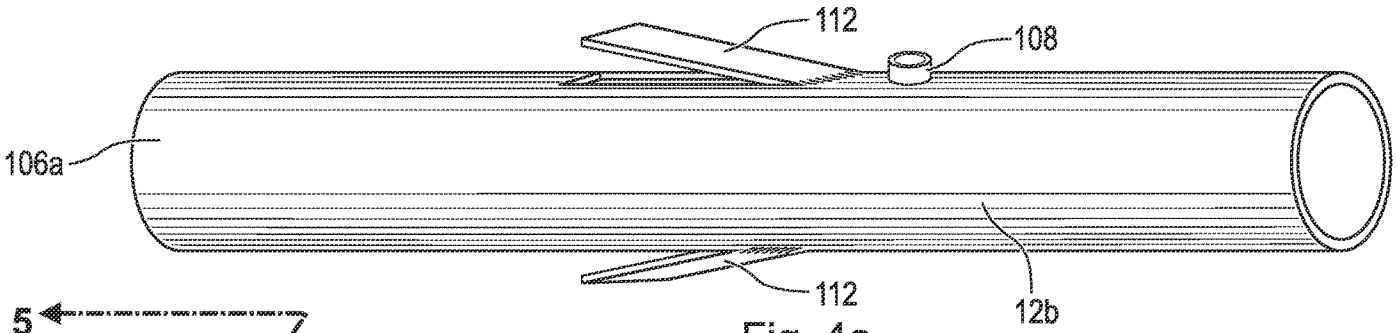
FIG. 4*a* depicts the novel gates extending angularly from the middle inlet pipe in exhaust system of the present invention.
Figure 4B:
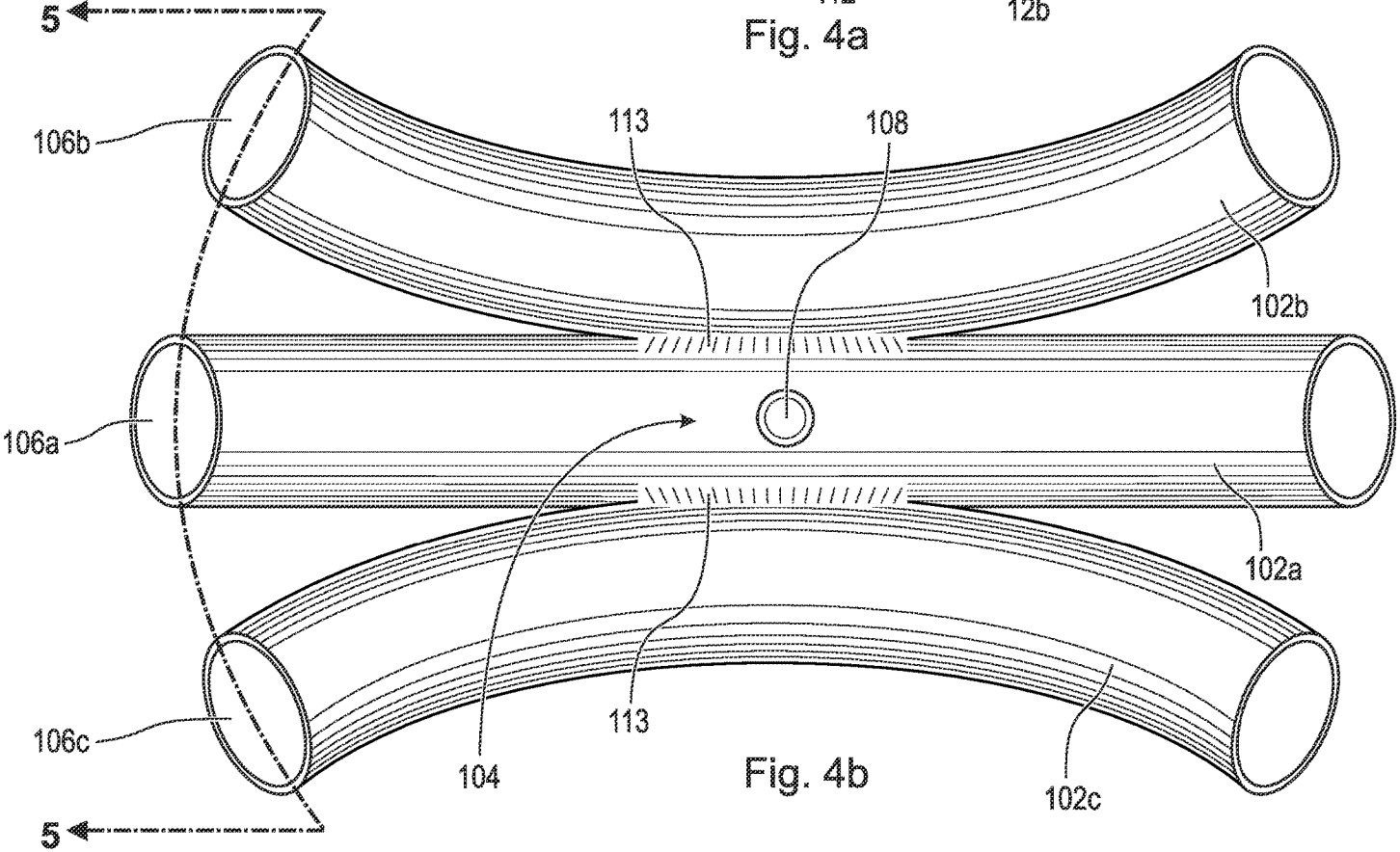
FIG. 4*b* shows a hatched region where the inventive gates extend into adjacent inlet pipes.

FIG. 4*a* depicts the inventive gates 112 that extend outward angularly from middle inlet pipe 106*a* into one of the outer adjacent exhaust inlet pipes. Preferably gates 112 are positioned on opposite sides of middle inlet pipe 106*a*. FIG. 4*b* illustrates a separate crossover section 104 to which inlet pipes 106 and outlet pipes 102 may be attached. Also seen shows area 113 where the three pipe sections may be attached by welding. Most preferably, gates 112 open into the adjacent inlet pipes upstream from receiver 108. By "upstream" is meant in the direction opposite to the flow of a stream, in this case the flow of exhaust gas from the engine toward the end of outlet pipes 102.

Figure 5:
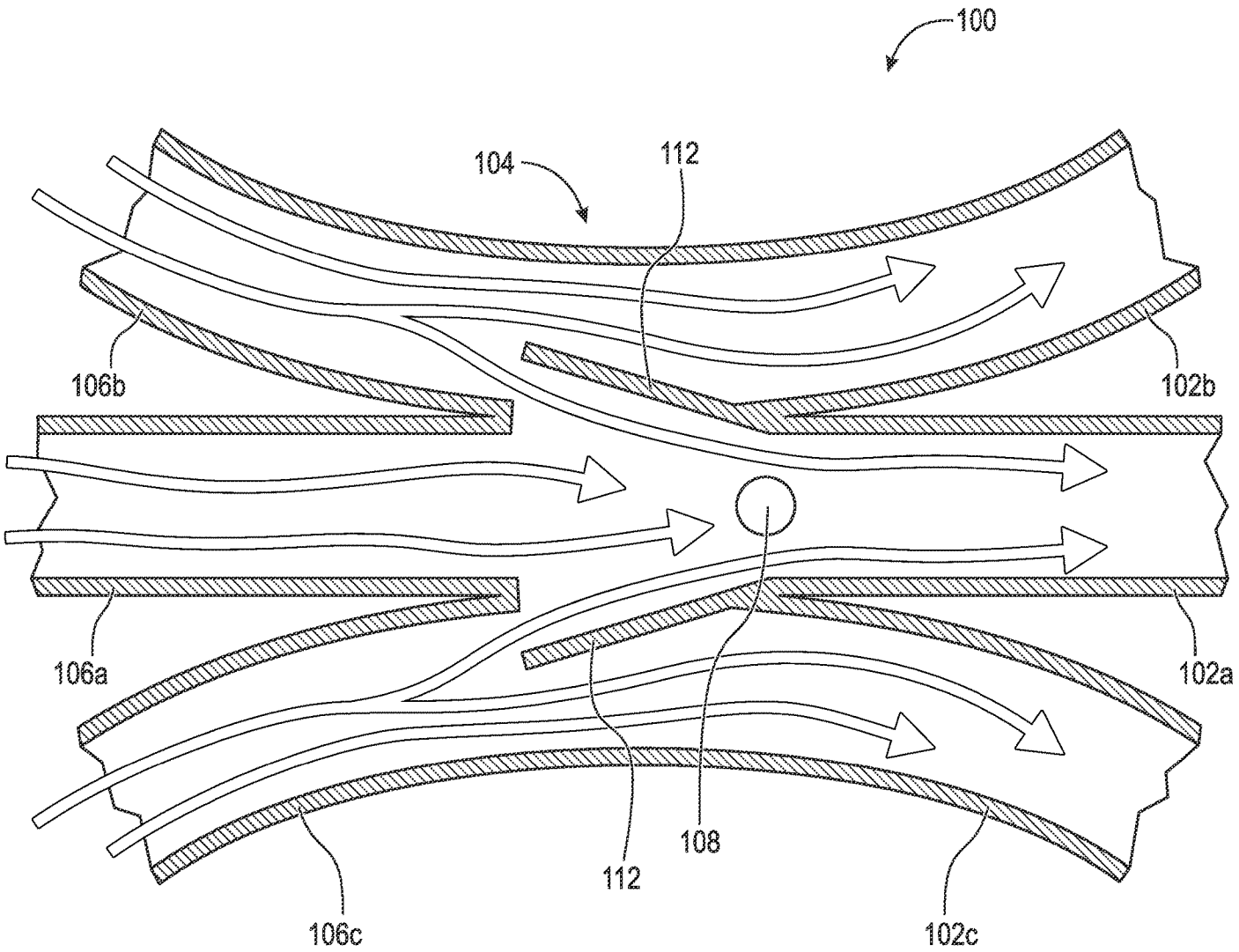
FIG. 5 is a cross-section view of the crossover section taken along 5-5 in FIG. 4*b* depicting the flow of exhaust in the crossover section.

FIG. 5 is a cross section of crossover section 104 taken along 5-5 in FIG. 4*b*. The arrows indicate the flow of exhaust gas from left to right passing through crossover section 104. In this cross-section view, gates 112 extend angularly into adjacent inlet pipes 106*b* and 106*c* upstream from receiver 108 thereby directing some of the exhaust gas flow in those pipes into middle pipe 106*a*. Thus, a mixture of exhaust gas from all three pipes passes by receiver 108 which can be measures by a sensor, for example an oxygen ($O_2$) sensor, positioned into receiver 108. As an example, in an exhaust pipe with a diameter of 1⅜ inches, gates 112 may be ⅝ inch wide and may extend ⅜ inch into adjacent pipes 106*b* and 106*c*. An example of oxygen sensor may be, but is not limited to, Honda part no. 36532-MKC-A01, supplied by Honda Motor Company. Persons of skill in the art will recognize that different engine sizes and exhaust systems 100 may require gates 112 to extend more or less than ⅜ inch into an adjacent exhaust pipe.

Figure 6:
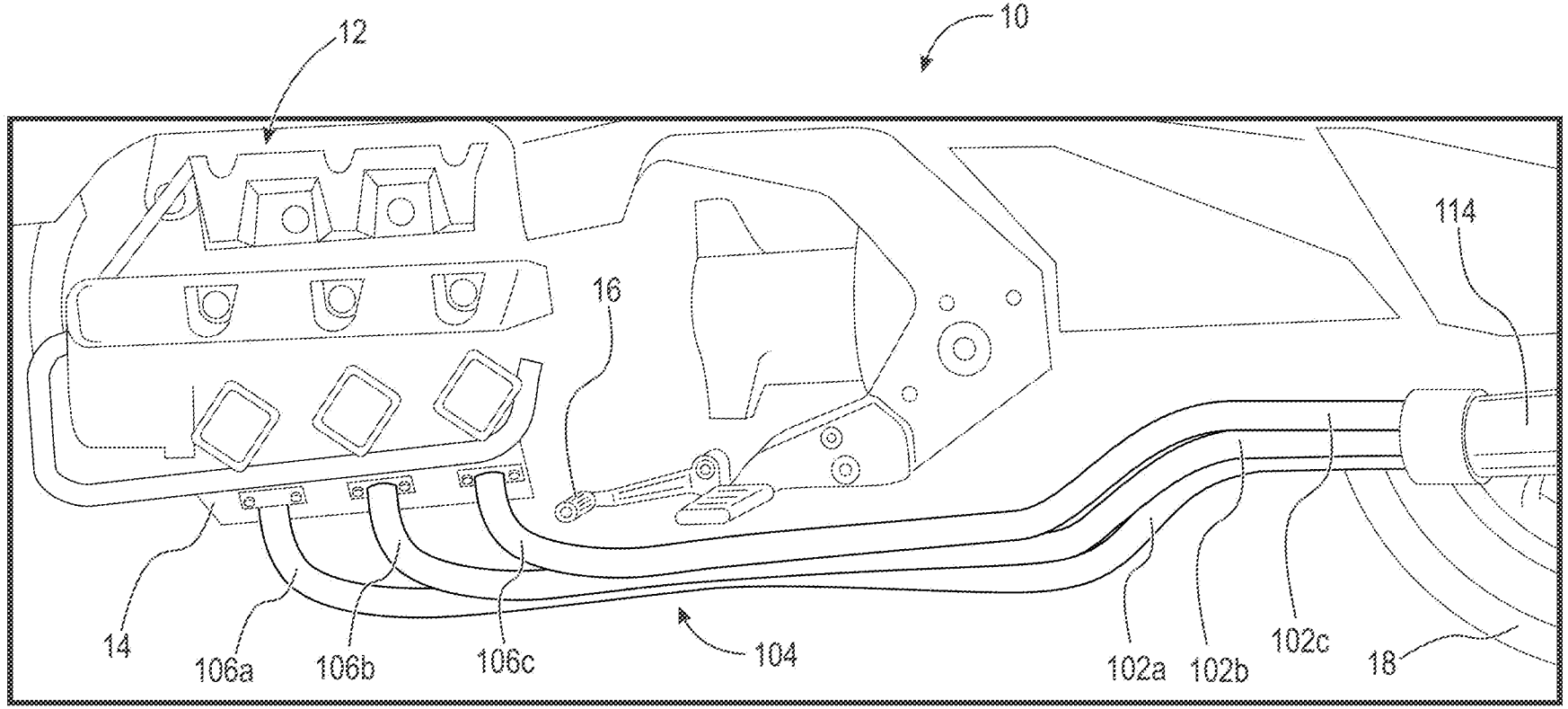
FIG. 6 is a schematic side view of exhaust system attached to a motorcycle; and, FIG. 7 is an enlarged view of the crossover section of the present invention showing a sensor in the middle pipe with a sensor cable leading to an on-board computer (ECM).

FIG. 6 is a schematic side view of exhaust system 100 attached to a motorcycle 10. Exhaust inlet pipes 106*a*, 106*b* and 106*c* are seen leading from exhaust manifold 14 to crossover region 104. Outlet pipes 102*a*, 102*b* and 102*c* extend from crossover region 104 past tire 18 to disperse exhaust gas away from motorcycle 100. In the example shown in FIGS. 4 and 6, the various inlet pipes 106 and outlet pipes 102 may actually be the same pipe with the different pipe regions upstream and downstream from crossover region 104 designated by different reference numbers. It can also be seen in an alternate embodiment that outlet pipes 102*a*, 102*b* and 102*c* can each lead into collector 114. In addition, persons skilled in the art will recognize that a similar arrangement to include collector 114 could be mounted to motorcycle 10 on the opposite side of engine 12 with a six-cylinder engine.

Persons of skill in the art will also recognize that separate inlet and outlet pipes may be joined with a separate crossover section 104 and still achieve the purpose of sensing and measuring a combined exhaust gas. The separate crossover section 104 includes a middle pipe and two outer pipes as seen in FIG. 4*b*. The separate section 104 also include appropriate gates 112 positioned in the middle pipe of separate section 104 that are upstream from a receiver 108 defined by the middle pipe and extend into the outer pipes. For example, a section 104 may have outer pipes and a middle pipe each with connection means to connect with intake pipes 106 with gates 112 upstream from receiver 108 and outlet pipes 102. Connection means may include friction fits, welds, clamps or other connection means know in the art.

Figure 7:
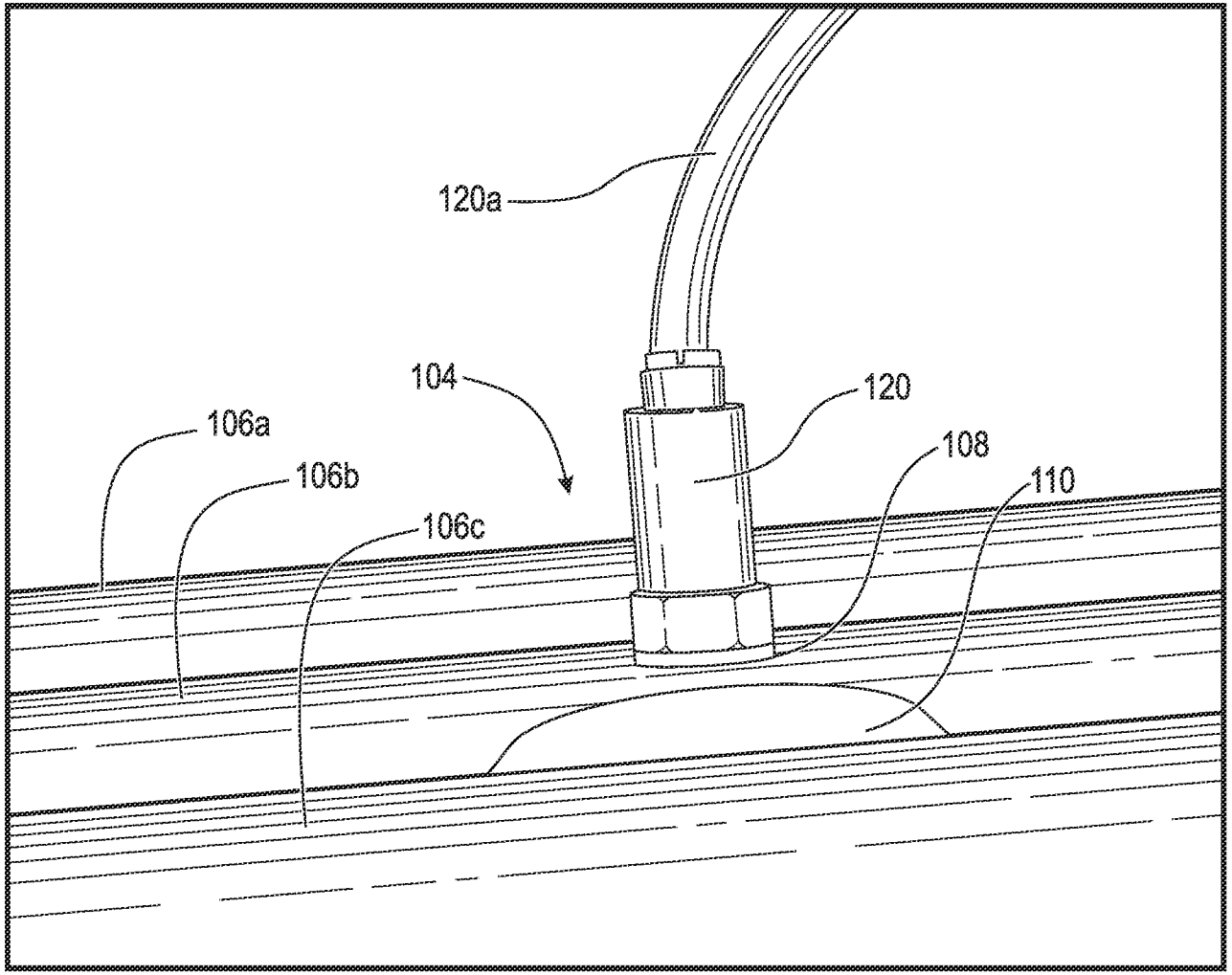

FIG. 7 is an enlarged view of crossover section 104 showing sensor 120 in middle pipe 106*b* with sensor cable 120*a* leading to an on-board computer or engine control unit (ECM) where the sensor measurements will be used to control engine performance parameters. One example of such parameters may be used to control air-fuel mixture based on exhaust oxygen measurement.

It will also be noted that exhaust systems 100 seen in FIGS. 1 and 6 have different configurations in that in FIG. 1 inlet pipe 106*a* is the middle pipe entering crossover region 104, while in FIG. 6 inlet pipe 106*b* is the middle pipe entering crossover region 104. Persons of skill in the art will recognize that the pipes of different exhaust systems 100 can be arranged to conform to obtain an efficient attachment to motorcycles, all-terrain vehicles and other vehicles while retaining the inventive gates 112 and crossover section 104 in these different system 100 configurations.

The present invention provides several advantages over the prior art as the gates 112 divert a portion of the exhaust gas from two outer exhaust inlet pipes (inlet pipes 106*b* and 106*c* in FIGS. 1-5 and inlet pipes 106*a* and 106*c* in FIGS. 6 and 7) into the middle pipe to create a mixed exhaust gas to be sampled by sensor 120. This allows a more accurate measurement of oxygen in the total exhaust emitted by engine 110 with this more accurate measurement being transmitted back the computer. The computer more accurately adjusts the air-fuel ratio, among other possible parameters, to keep that ratio within the optimal operating parameters of the engine. This prevents loss of power and generates a smoother running engine and increased mileage.

Thus, it is seen that the objects of the invention are efficiently obtained, although changes and modifications to the invention should be readily apparent to those having ordinary skill in the art, which changes would not depart from the spirit and scope of the invention as claimed.

I claim:

1. An exhaust system for an internal combustion engine comprising:

a first exhaust pipe having an intake end and an exhaust end;

a middle exhaust pipe having an intake end and an exhaust end;

a third exhaust pipe having an intake end and an exhaust end;

a crossover section wherein said first exhaust pipe and said third exhaust pipe are attached to said middle pipe within said crossover section;

a receiver defined by said middle pipe within said crossover section;

a first gate extending angularly from said middle pipe into said first pipe within said crossover section; and, a second gate extending angularly from said middle pipe into said third pipe within said crossover section;

wherein each of said first gate and said second gate are positioned upstream from said receiver.

2. The exhaust system according to claim 1 wherein each of said first gate and said second gate are positioned directly opposite each other in said middle pipe.

3. The exhaust system according to claim 1 further comprising a sensor sized to fit into said receiver.

4. The exhaust system according to claim 3 wherein said sensor is an oxygen sensor.

5. The exhaust system according to claim 1 wherein said first and second gates are each angled to form a crossover intake into said middle pipe.

6. The exhaust system according to claim 5 wherein each of said crossover intakes is 5/16 inch wide.

7. The exhaust system for an internal combustion engine according to claim 1 further comprising a collector fabricated to receive each of said first exhaust pipe exhaust end, said middle exhaust pipe exhaust end and said third exhaust pipe exhaust end.

8. A vehicle having an internal combustion engine comprising:

an exhaust header attached to said internal combustion engine;

a first exhaust system including;

a first exhaust pipe having an intake end and an exhaust end said intake end attached to a first exhaust outlet of said header;

a middle exhaust pipe having an intake end and an exhaust end said intake end attached to a second exhaust outlet of said header;

a third exhaust pipe having an intake end and an exhaust end said intake end attached to a third exhaust outlet of said header;

a crossover section wherein said first exhaust pipe and said third exhaust pipe are fastened to said middle pipe within said crossover section;

a receiver defined by said middle pipe within said crossover section;

a first gate extending angularly from said middle pipe into said first pipe within said crossover section; and, a second gate extending angularly from said middle pipe into said third pipe within said crossover section;

wherein each of said first gate and said second gate are positioned upstream from said receiver.

9. The vehicle according to claim 8 wherein each of said first gate and said second gate are positioned directly opposite each other in said middle pipe.

10. The vehicle according to claim 8 further comprising a sensor sized to fit into said receiver.

11. The vehicle according to claim 10 wherein said sensor is an oxygen sensor.

12. The vehicle according to claim 8 wherein said first and second gates are each angled to form crossover intake into said middle pipe.

13. The vehicle according to claim 12 wherein each of said crossover intakes is 5/16 inch wide.

14. The vehicle according to claim 8 wherein said internal combustion engine is a three cylinder engine.

15. The vehicle according to claim 8 further comprising a second exhaust header and a second exhaust system including;

a first exhaust pipe having an intake end and an exhaust end said intake end attached to a first exhaust outlet of said second header;

a middle exhaust pipe having an intake end and an exhaust end said intake end attached to a second exhaust outlet of said second header;

a third exhaust pipe having an intake end and an exhaust end said intake end attached to a third exhaust outlet of said second header;

a second crossover section wherein said first exhaust pipe and said third exhaust pipe are fastened to said middle pipe within said second crossover section;

a second receiver defined by said middle pipe within said second crossover section;

a first gate extending angularly from said middle pipe into said first pipe within said second crossover section; and, a second gate extending angularly from said middle pipe into said third pipe within said second crossover section;

wherein each of said first gate and said second gate are positioned upstream from said second receiver.

16. The vehicle according to claim 15 further comprising a second oxygen sensor sized to fit into said second receiver.

17. The vehicle according to claim 10 further comprising at least one on board computer designed to receive a signal from said sensor.

18. The vehicle according to claim 15 wherein said second exhaust system further comprises a collector fabricated to receive each of said first exhaust pipe exhaust end, said middle exhaust pipe exhaust end and said third exhaust pipe exhaust end.

19. The vehicle according to claim 15 further comprising at least one on board computer designed to receive a signal from said first and second sensors.

20. A crossover section for an exhaust system comprising:

a middle pipe having an input end and an output end;

a first outer pipes having an input end and an output end and in contact with and attached to said middle pipe;

a second outer pipe having an input end and an output end and in contact with and attached to said middle pipe;

a first gate extending angularly from said middle pipe into a first outer pipe;

a second gate extending angularly from said middle pipe into said second outer pipe within said crossover section; and, a receiver defined by said middle pipe and downstream from said first gate and said second gate.

21. The vehicle having an internal combustion engine according to claim 8 further comprising a collector fabricated to receive each of said first exhaust pipe exhaust end, said middle exhaust pipe exhaust end and said third exhaust pipe exhaust end.

22. The crossover section of claim 20 wherein each of said middle pipe, said first outer pipe and said second outer pipe include connection means to pipes at said input ends and said output ends.

23. The crossover section of claim 20 further comprising a sensor sized to fit into said receiver.

* * * * *